US005520374A

United States Patent [19]

Stomp et al.

[11] Patent Number: 5,520,374

[45] Date of Patent: May 28, 1996

[54] DEVICE FOR COUPLING A METALLURGICAL CARRIAGE TO A FLEXIBLE CONDUIT

[75] Inventors: Hubert Stomp, Luxembourg-Howald; Albert Feitler, Strassen, both of Luxembourg; Bernard Gramczewski, Longuyon, France

[73] Assignee: Paul Wurth S.A., Luxembourg

[21] Appl. No.: 390,297

[22] Filed: Jan. 31, 1995

[30] Foreign Application Priority Data

Feb. 2, 1994 [LU] Luxembourg ..... 88 457

[51] Int. Cl.[6] ..... C21C 7/00

[52] U.S. Cl. ..... 266/217; 266/46; 266/265

[58] Field of Search ..... 266/217, 265, 266/46, 220, 218, 216

[56] References Cited

U.S. PATENT DOCUMENTS 4,883,259 11/1989 Stomp et al. ..... 266/217
5,065,986 11/1991 Perri ..... 266/217

FOREIGN PATENT DOCUMENTS 0320841 6/1989 European Pat. Off. .
0537536 4/1993 European Pat. Off. .
87868 12/1990 Luxembourg .

OTHER PUBLICATIONS

Stahl und Eisen, vol. 107, No. 25/26, Dec. 14, 1987 Dusseldorf DE, p. 1213.
Stahl und Eisen, vol. 111, No. 6, Jun. 14, 1991, Dusseldorf DE, pp. 81–82, XP 000209374 "Neuentwicklungen für die Pfannenmetallurgie".

*Primary Examiner*—Scott Kastler
*Attorney, Agent, or Firm*—Fishman, Dionne & Cantor

[57] ABSTRACT

A device for coupling a metallurgical carriage to a flexible conduit comprises a first half-coupling mounted on the metallurgical carriage and a second half-coupling connected to one end of the flexible conduit. A coupling station is located near a predefined coupling position for the metallurgical carriage. This coupling station comprises a supporting block designed to receive and support the second half-coupling, driving means to move the supporting block from a parked position in the direction of the first half-coupling and vice versa. The second half-coupling is equipped with a locking device which can be actuated by a control device on the coupling station. In a first position of the locking device, the second half-coupling is coupled and locked to the first half-coupling; and in a second position of the locking device, the second half-coupling is coupled and locked to its support on the coupling station.

25 Claims, 4 Drawing Sheets

DEVICE FOR COUPLING A METALLURGICAL CARRIAGE TO A FLEXIBLE CONDUIT

BACKGROUND OF THE INVENTION

This invention relates to apparatus for coupling a metallurgical carriage to a flexible conduit. More particularly, this invention relates to apparatus for automatically effecting the coupling of a flexible conduit to a metallurgical carriage at a predetermined location of travel of the metallurgical carriage.

It is known to treat steel contained in a metallurgical ladle by gas injection while the ladle is being transported on a metallurgical carriage, for example towards a continuous casting caster. For this purpose porous bricks are incorporated into the base of the metallurgical ladle and are connected permanently to gas pipes affixed to the ladle. These gas pipes on the ladle are connected by a disconnectable coupling to gas distribution pipes installed on the metallurgical carriage.

From U.S. Pat. No. 4,883,259, the entire contents of which are incorporated herein by reference, a coupling device is known, which makes it possible to automatically connect the gas pipes of the metallurgical ladle to the gas pipes on the metallurgical carriage, when the metallurgical ladle is placed on the metallurgical carriage. This coupling device has the advantage of rendering unnecessary any human intervention with the metallurgical carriage in order to connect the metallurgical ladle to the gas pipes of the metallurgical carriage.

The gas pipes of the metallurgical carriage are themselves connected to a stationary gas supply circuit through a flexible conduit or hose of considerable length. During the movement along its running track, the metallurgical carriage consequently drags its flexible supply pipe along behind itself. In other words, the flexible conduit forms a kind of umbilical cord connecting the movable metallurgical carriage to fixed installations.

In order to avoid having to connect the flexible conduit to the metallurgical carriage carrying a ladle filled with steel, which would expose a worker to great risks, there is now common practice to leave this flexible supply pipe connected permanently to the metallurgical carriage. This way of proceeding means, however, that the metallurgical carriage must drag its flexible supply pipe along even when a gas supply to the ladle is not required. This gives rise to the particular disadvantages that the flexible conduit is needlessly exposed to wear and to the risk of accidental rupture, and that its length has to be far greater than the length actually required to supply the metallurgical carriage with gas over a limited section of the running track on which the carriage travels.

SUMMARY OF THE INVENTION

The present invention proposes a device for the coupling of a metallurgical carriage to at least one flexible conduit or hose which does not require human intervention in the immediate proximity of the metallurgical carriage, for the operation of coupling.

The objective of the present invention is attained by a device for coupling a metallurgical carriage to a flexible conduit comprising:

- a first half-coupling mounted on the metallurgical carriage;

- a second half-coupling connected to one end of at least one flexible conduit and designed so as to be capable of being received on the first half-coupling;
- a coupling station that is located near a predetermined coupling position for the metallurgical carriage, this coupling station comprising:
  - a supporting block designed to receive and support the second half-coupling;
  - drive means for moving the supporting block from a parked position in the direction of the first half-coupling and vice versa, when the metallurgical carriage is in its predetermined coupling position, and
  - a control device;

The second half-coupling includes a locking de;vice which can be actuated by the control device and which defines a first locking position, in which it co-operates with at least one element of the first half-coupling so as to lock the second half-coupling in a position coupled to the first half-coupling, and a second locking position, in which it co-operates with at least one element of the support so as to lock the second half-coupling to its support on the coupling station.

In order to connect the flexible conduit to the mobile metallurgical carriage, the carriage is stopped at a predetermined coupling position on its running track. The coupling station is located near this coupling position. The supporting block of the coupling situation is in its parked position and supports the second half-coupling. The locking device of the second half-coupling is in its second locking position, in which it co-operates with at least one element of the supporting block so as to lock the second half-coupling to the supporting block. The supporting block is then moved with the second half-coupling from its parked position in the direction of the first half-coupling, and the second half-coupling is received axially on the first half-coupling. The control device of the coupling station is then actuated in order to impose on the locking device of the second half-coupling its first locking position, in which it co-operates with at least one element of the first half-coupling so as to lock the second half-coupling in a coupled position to the first half-coupling. All that then remains is to move the empty supporting block into its parked position to terminate the operation of connecting the metallurgical carriage to the flexible conduit. The metallurgical carriage can now continue its travel while dragging along the flexible conduit.

In order to disconnect the flexible conduit from the mobile metallurgical carriage, the carriage is once again stopped at a predetermined coupling position on its running track. The coupling station with its empty supporting block in its parked position is located near this coupling position. The supporting block is then moved from its parked position in the direction of the second half-coupling. The control device of the coupling station is then actuated in order to impose on the locking device of the second half-coupling its second locking position, in which it co-operates with at least one element of the supporting block so as to lock the second half-coupling to the supporting block of the coupling station. All that then remains is to move the supporting block with the second half-coupling into its parked position in order to terminate the operation of disconnecting the flexible conduit. The metallurgical carriage can now continue its travel without having to drag along the flexible conduit.

It will be appreciated that the proposed device is particularly simple and does not require auxiliary power on the metallurgical carriage in order to carry out the coupling.

According to the prior art, the metallurgical carriage was fitted with a structure for fixing and guiding the flexible conduit. In a preferred embodiment of the present invention, it is the second half-coupling which forms a unit with a structure for fixing and guiding the flexible conduit. Thus, optimum guidance of the flexible conduit is guaranteed in a simple but ingenious way, both on the metallurgical carriage and on the coupling station.

In order to couple the second half-coupling to the supporting block, the supporting block preferably incorporates a first pair of pins parallel to the coupling axis which are capable of becoming engaged in a first pair of drilled holes in the second half-coupling. In order to couple the second half-coupling to the first half-coupling, the first half-coupling preferably has a second pair of pins parallel to the coupling axis which are capable of becoming engaged in a second pair of drilled holes in the second half-coupling. This embodiment is simple and robust and permits an efficient centering of the second half-coupling on the supporting block and on the first half-coupling. In order to improve the efficiency of the centering, the pins of a pair are preferably symmetrical with respect to the coupling axis.

The locking device preferably comprises a locking plate which is movable between a first position and a second position, so that in the first position it becomes engaged in recesses in the first pair of pins in order to lock the second half-coupling to the supporting block of the coupling station, and so that in the second position it becomes engaged in recesses in the second pair of pins in order to lock the second half-coupling to the first half-coupling.

In order to actuate this locking plate, the locking plate is preferably equipped with an actuating lever. The control device then includes two control actuators symmetrical with respect to the actuating lever. In a harsh environment, this is a simple and reliable device for controlling the locking of the second half-coupling, either to the first half-coupling or to the supporting block of the coupling device. It will also be appreciated that the auxiliary power required to actuate the control device need be available only on the coupling station.

The first half-coupling is preferably mounted on the metallurgical carriage so as to have one degree of freedom along a first direction perpendicular to the coupling axis, and the supporting block is mounted on the coupling station so as to have one degree of freedom along a second direction which is perpendicular to the coupling axis and perpendicular to the first direction. The degree of freedom of the supporting block is preferably a horizontal degree of freedom defined symmetrically about a central position by elastic elements. The degree of freedom of the first half-coupling is preferably a vertical degree of freedom defined against elastic elements producing an upward elastic force. In this way, the first half-coupling and the supporting block can be self-aligning along the coupling axis, while preserving the rigidity and robustness necessary in this environment.

One of the two half-couplings preferably incorporates a male half-connector which co-operates with a female half-connector on the other half-coupling. The male half-connector is then preferably capable of sliding axially against the action of a spring so as to create, during the coupling of the two half-couplings, a contact pressure between the two half-connectors. This embodiment guarantees sufficient contact pressure between the two half-connectors without risking their destruction by an excessive axial coupling force.

The flexible conduit normally comprises at least one flexible gas pipe.

Other advantages and special features will be apparent to and understood by those skilled in the art from the detailed description of a preferred embodiment of the present invention, based on the appended FIGURES.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
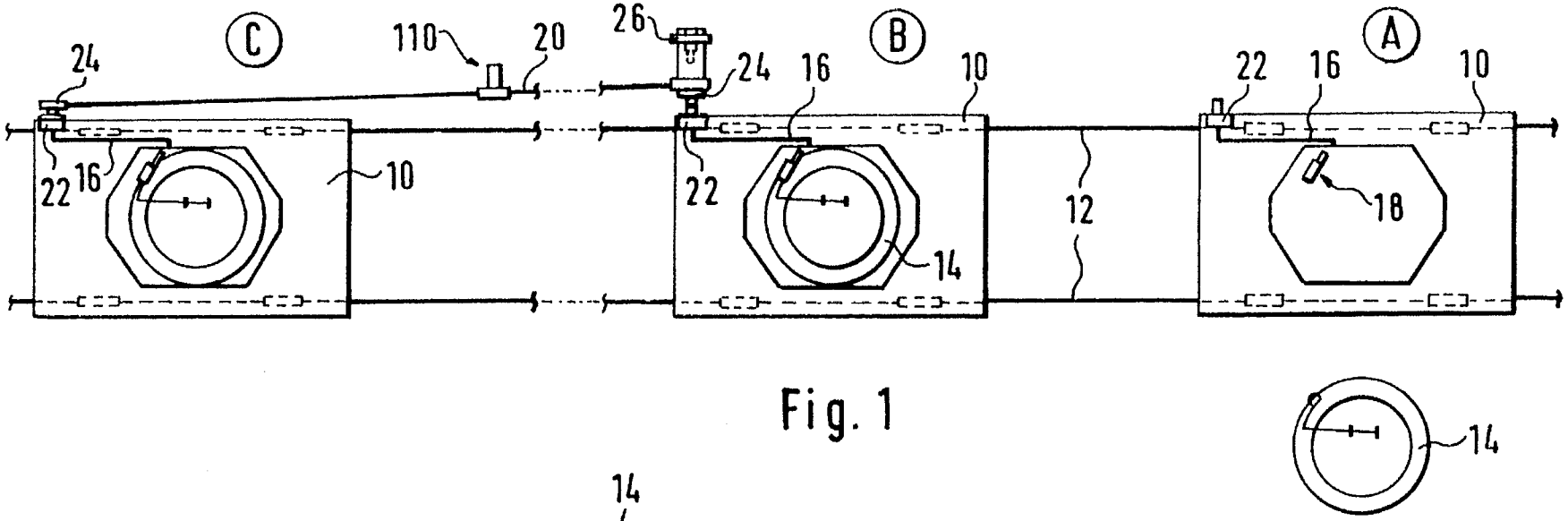
FIG. 1 is a plan view of a metallurgical carriage in different positions.

FIG. 1 shows a plan view of a metallurgical carriage 10 which is capable of moving along a running track 12 from a position A on the right of the drawing to a position C on the left of the drawing. This is a carriage of the type used in steel plants to transport a metallurgical ladle 14, for example towards a continuous caster.

In position A, which is most frequently located outside the building containing the steel plant itself, the carriage 10 receives an empty metallurgical ladle 14. The carriage 10 then conveys the metallurgical ladle 14 to position B, where the ladle itself is filled with steel. In position C, ladle 14 is removed from the carriage 10 in order to pour the steel, for example into the tundish (not shown) of a continuous caster.

Between position B and position C the steel in ladle 14 is subjected to "bubbling" by injecting a gas through the bottom of ladle 14. For this purpose, ladle 14 is connected, when it is placed in carriage 10, to a distribution circuit 16 for the supply of one or more treatment gases to the bottom of ladle 10. This distribution circuit 16 is attached to the metallurgical carriage 10. It has already been pointed out that the connection of ladle 14 to circuit 16 may for example be achieved automatically with the help of a coupling device 18 of the type described in U.S. Pat. No. 4,883,259.

In the prior state of the art, the gas distribution circuit 16 was permanently connected to a flexible supply pipe which the carriage 10 dragged along behind itself, from position A to position C and vice versa. This flexible supply pipe had therefore to have a minimum length $L_{MIN}$=AC/2 where AC represents the distance from A to C. However, the coupling device according to the present invention, which will be described below, enables this minimum length of the flexible conduit to be reduced to BC/2 where BC represents the distance from B to C. In effect, because of the device according to the present invention, a flexible conduit 20 may be automatically connected to, and disconnected from, distribution circuit 16 of carriage 10 in at least one coupling position defined in the immediate neighborhood of position B. Since position B is a danger zone, it is important to stress that the device according to the present invention enables the coupling and uncoupling of flexible conduit 20 to be carried out without human intervention in this danger zone.

A coupling device according to the invention comprises at least the following three distinct units (see FIG. 1):

(a) a first half-coupling 22 mounted on carriage 10 and connected to circuit 16 of carriage 10;

(b) a second half-coupling 24 connected to a free end of at least one flexible conduit 20;

(c) a coupling station 26 located alongside the predefined coupling position, at position B, for metallurgical carriage 10 on its running track 12.

Figure 3:
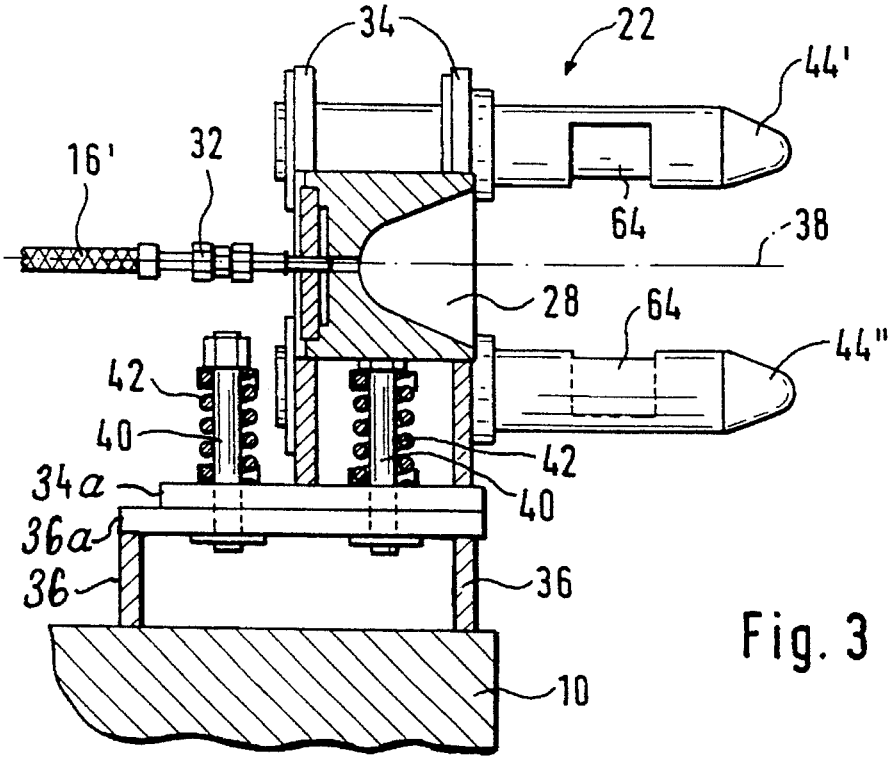
FIG. 3 is a cross-section, taken along line 3—3 of FIG. 4 through a half-coupling mounted on the carriage of FIG. 1.
Figure 4:
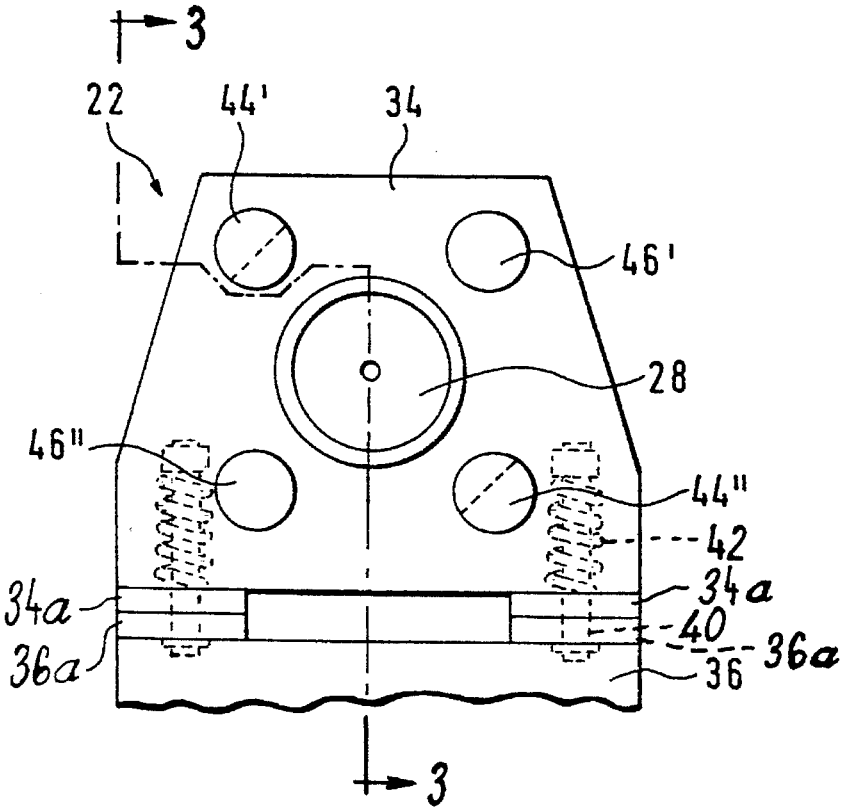
FIG. 4 is a front view of the half-coupling of FIG. 3.

The first half-coupling 22 mounted on the carriage 10 will be described with reference to FIGS. 3 and 4. In FIG. 4, it can be seen that half-coupling 22 is a half-coupling supporting a female component (or female half-connector) 28 which forms, with a corresponding male component (or male half-connector) 30 of the second half-coupling 24 (see FIG. 5), a connection for gas flow. In the embodiment shown in FIG. 3, this is more particularly a connection for two different gases. It could, however, also be a connection for a single gas or for more than two gases. In FIG. 3 element 32 is a fixed connection between the female component 28 and a pipe 16' forming part of circuit 16 on carriage 10. It can also be seen that the female component 28 defines a kind of bowl into which the male component 30 can automatically center itself when it enters.

Figure 2:
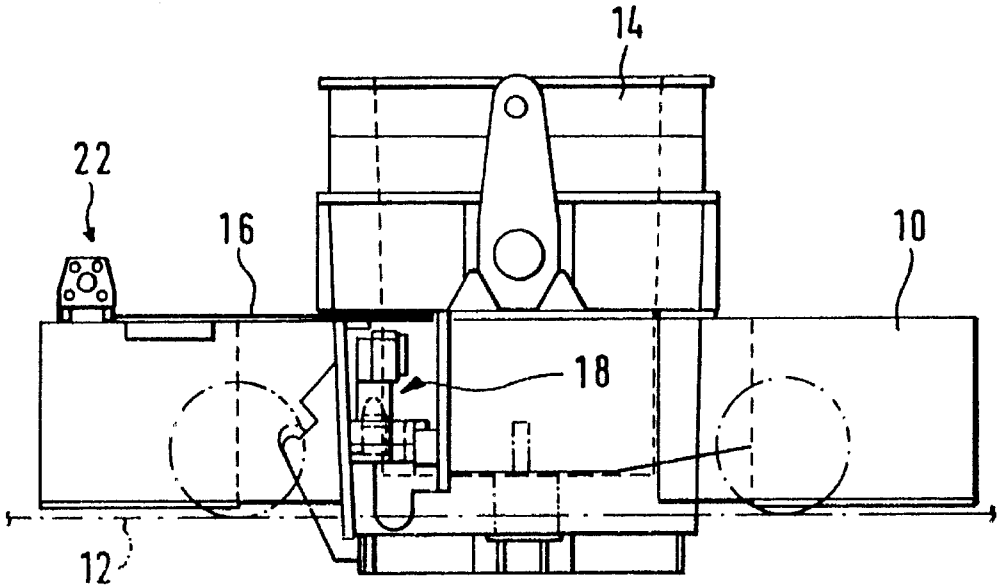
FIG. 2 is an elevation view of the metallurgical carriage of FIG. 1.

Female component 28 is attached to a frame of vertical plates 34 attached to horizontal cross plates 34(*a*). That frame is, in turn, mounted on horizontal cross plates 36(*a*) which form part of supporting plates 36 fixed laterally to carriage 10. It will be appreciated that the half-connector 28 forming part of the first half-coupling 22 has no protruding part which might be damaged on the carriage 10. FIG. 2 shows the mounting of first half-coupling 22 on carriage 10. It can be seen that the central axis of female component 28 defines a coupling axis 38 which is preferably horizontal and perpendicular to running track 12. Frame 34, 34(*a*) is preferably mounted on cross plate 36(*a*) and supporting plates 36 using four rods 40 (only two of which are seen in FIG. 3) on which the frame 34, 34(*a*) can slide in a direction perpendicular to the axis 38. Compression springs 42 then push frame 34, 34(*a*) against supporting plates 36, 36(*a*). In this way, the first half-coupling has the freedom to be lifted, along the axis of rods 40, from its supporting plates 36, 36(*a*) against the action of the springs 42. Frame 34, 34(*a*) is also fitted with a pair of pins 44' and 44" whose axes are parallel to the coupling axis 38. In addition, these two pins 44' and 44" are preferably symmetrical with respect to the coupling axis 38. Frame 34 also has a pair of drilled holes 46' and 46" receiving a second pair of pins as described later.

The second half-coupling 24, which is connected to the free end of flexible conduit 20, will be described with reference to FIGS. 5 and 6. The male component 30, which forms the gas connection in co-operation with the female component 28, is mounted in a frame 50. This mounting is preferably achieved in such a way that the male component 30, which protrudes from a frame 50, is capable of axial movement in frame 50 against the action of a spring 52. Spring 52 surrounds male component 30 and bears at one end axially, via a spring plate 53, or frame 50 and bears axially at the end on male component 30. A rear shoulder 54 and a front shoulder 56, which are both attached to the male component 30, cooperate with bearing surfaces attached to the frame 50 so as to limit the axial travel of the male component 30 in two opposite directions. It will be seen that, during the coupling of the second half-coupling to the first half-coupling, it is spring 52 which establishes the contact pressure between male component 30 and female component 28. In this connection, it will also be appreciated that, when the second half-coupling is coupled to the first half-coupling, the two frames 34 and 50 provide effective protection for the two half-connectors 28 and 30.

The frame 50 of the second half-coupling also includes a first pair of drilled holes 58' and 58" (see FIG. 6) and a second pair of drilled holes 60' and 60". The first pair of drilled holes 58' and 58" is positioned so as to receive the pair of pins 44' and 44" of the first half-coupling 22. The second pair of drilled holes 60' and 60" is positioned so as to receive a pair of pins 62' and 62" (see FIGS. 7–9) which are symmetrical to the pair of pins 44' and 44", but which are supported by the coupling station 26. All these pins 44', 44", 62' and 62" are cylindrical components with pointed ends that engage easily in the corresponding drilled holes 58' and 58", 60' and 60", but which also provide an accurate enough guidance of the second half-coupling along the coupling axis. Each pin 44', 44", 62' and 62" also has a recess 64 whose function will be described later in connection with the locking of the second half-coupling to the first half-coupling 22 and to the coupling station 26.

Figure 5:
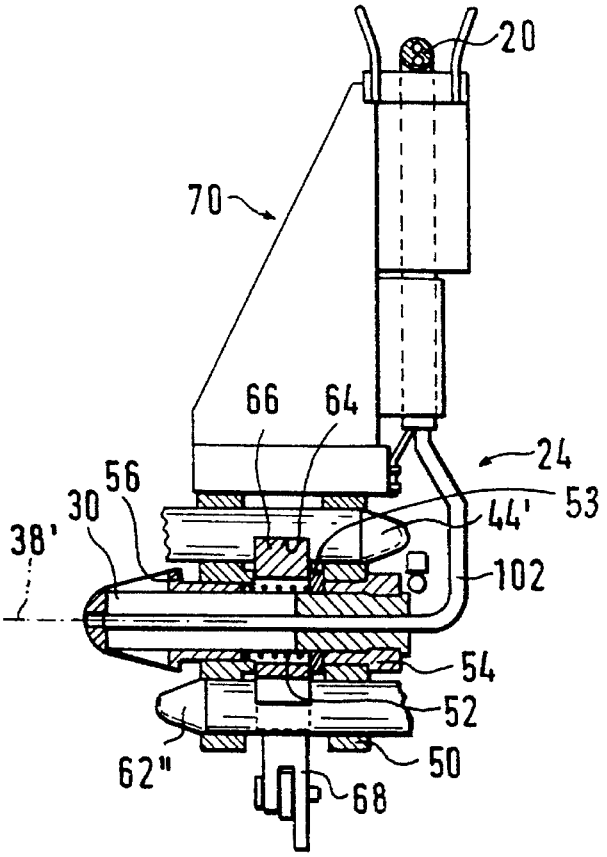
FIG. 5 is a cross-section through a second half-coupling which may be coupled to the first half-coupling of FIG. 3.
Figure 6:
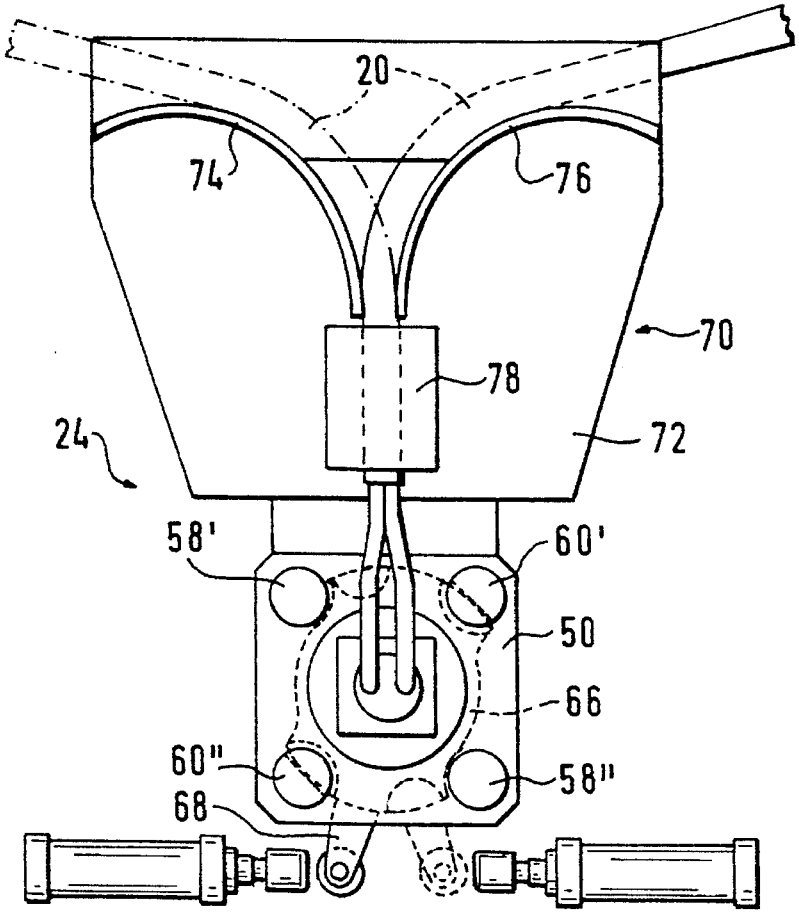
FIG. 6 is a front view of the second half-coupling of FIG. 5.

Referring to FIGS. 5 and 6, a locking plate 66 is incorporated in frame 50 of the second half-coupling. Locking plate 66 is, for example, an annular plate which is housed in frame 50 so as to be able to rotate about the male component 30. A lever 68 extends from plate 66 outside frame 50 and enables plate 66 to be actuated. It can be seen in FIG. 6 that the shape of plate 66 is designed in such a way:

(1) that, in a first position, its peripheral edge enters the recesses 64 in the two pins 62' and 62" introduced through the drilled holes 60' and 60", while leaving completely free the passages through the pair of drilled holes 58' and 58" receiving the pins 44' and 44";

(2) that, in a second position, its peripheral edge enters the recesses 64 in the two pins 44' and 44" introduced through the drilled holes 58' and 58" while leaving completely free the passages through the pair of drilled holes 60' and 60".

In the first position of the locking plate, supporting frame 50 of the second half-coupling is consequently locked axially to the two pins 62' and 62" attached to the coupling station 26. In the second position of locking plate 66, the second half-coupling is, on the other hand, locked axially to the two pins 44' and 44" attached to the first half-coupling. Lever 68 enables locking plate 66 to be pivoted from the first to the second position and vice versa.

It can also be seen in FIGS. 5 and 6 that second half-coupling 24 is attached to a guiding and fixing structure 70 for flexible conduit 20. Structure 70 comprises a supporting plate 72 and two guiding surfaces 74 and 76 which are perpendicular to the supporting plate 72. Guiding surface 74 defines a minimum radius of bending for flexible conduit 20 in a first direction of movement of the carriage 10; and guiding surface 76 defines a minimum radius of bending for conduit 20 in the opposite direction. The end of flexible conduit 20 is mechanically fixed to supporting plate 72 by a strap 78.

Figure 7:
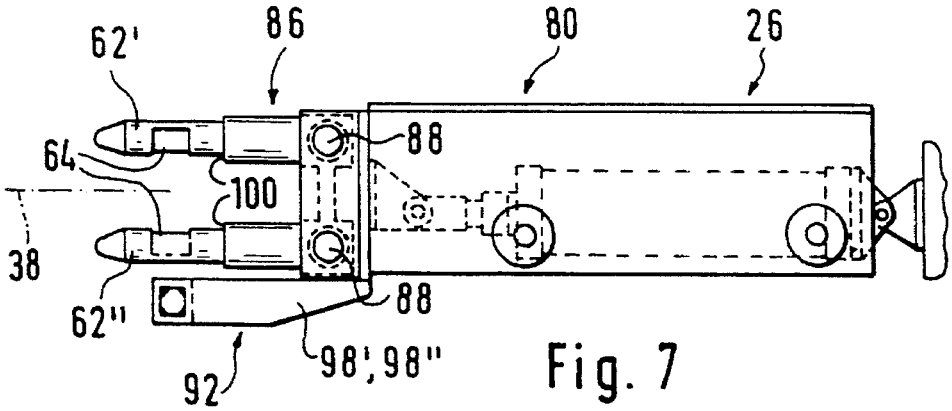
FIG. 7 is an elevation of a coupling station receiving the half-coupling of FIG. 5.
Figure 8:
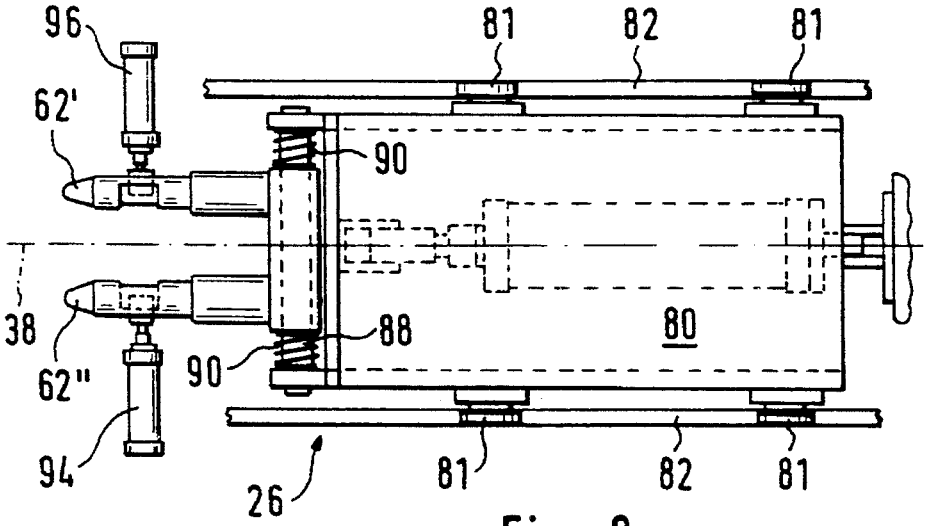
FIG. 8 is a plan view of the coupling station of FIG. 7.
Figure 9:
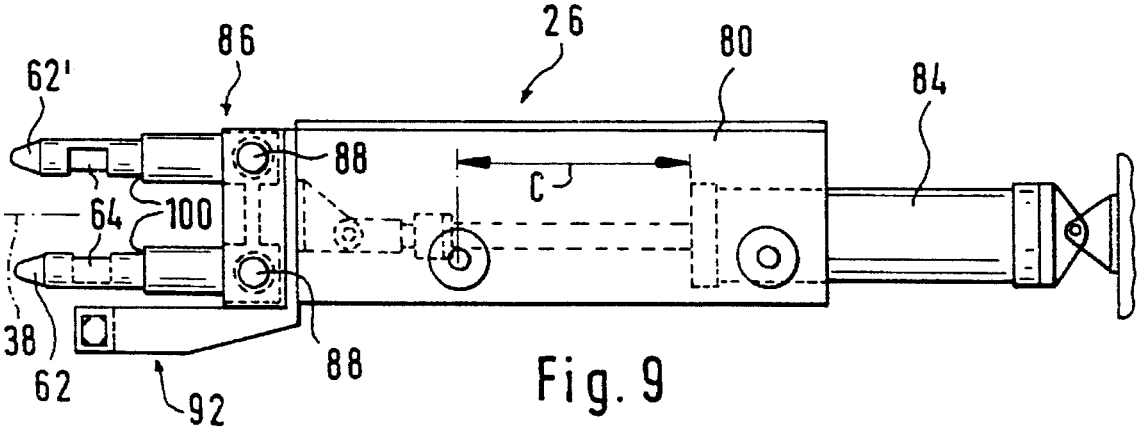
FIG. 9 is a view similar to FIG. 7 showing a second position of the coupling station.

The third unit of the device, i.e. coupling station 26, is described with reference to FIGS. 7, 8 and 9. Coupling station 26 comprises a coupling carriage 80 capable of moving with the help of rollers 81 along guide rails 82 (see FIG. 8). Guide rails 82 are supported by a supporting structure (not shown) so that carriage 80 can be moved along guide rails 82 from a parked position, located laterally alongside the running track 12, in the direction of first half-coupling 22 parallel to the coupling axis 38 of the latter, if the metallurgical carriage 10 is in its predefined coupling position. The means for driving coupling carriage 80 is, for example, a hydraulic or pneumatic actuator 84 which produces a displacement of travel C of the coupling carriage 80 (see FIG. 9). Of course, it would also be possible to use any other driving device capable of producing a rectilinear to-and-fro movement of travel C.

Carriage 80 itself supports at its front end a supporting block 86 which is designed to receive and support, along the coupling axis 38, the second half-coupling 24. For this purpose, supporting block 86 includes the pair of pins 62' and 62" which have been described above. It will be noted that supporting block 86 is not fixed rigidly to coupling carriage 80 but that it is supported in such a way that it can slide in a direction perpendicular to the axis 38, for example on a pair of rods 88 mounted at the front end of carriage 80. Rods 88 are preferably oriented in a direction perpendicular to the direction defined by rods 40 of the first half-coupling In the drawings, the rods 40 are, for example, vertical, whereas the rods 88 are horizontal. Springs 90 then elastically define a central position of supporting block 86 on the pair of rods 88.

Coupling carriage 80 also supports a control device 92 for lever 68 of locking plate 66 of second half-coupling 24. Control device 92 comprises, for example, two control actuators 94 and 96 which are positioned on the arms 98' and 98" of the coupling carriage 80 so that they are in the pivoting plane of locking plate 66, on both sides of lever 68, when the pins 62' and 62" are completely engaged in the drilled holes 60' and 60" of the second half-coupling In this connection, it will be noted that pins 62' and 62" are each fitted with a shoulder 100 which co-operates with bearing surfaces on the second half-coupling so as to define an axial positioning of the second half-coupling on the pins 62' and 62" for which locking plate 66 may enter recesses 64.

In order to explain the operation of the device described above, reference will be made to FIG. 1, while simultaneously consulting all the other FIGURES as regards the details.

From position A to position B, carriage 10 supporting an empty ladle 14 is not connected to flexible conduit 20. In position B, carriage 10 is stopped on its running track 12 in a predefined coupling position. Second half-coupling 24 is supported and locked on supporting block 86 of coupling station 26. For this purpose, locking plate 66 enters the recesses 64 in the pins 62' and 62" of the coupling carriage 80. Coupling carriage 80 is in its parked position.

Actuator 84 is then actuated in order to move coupling carriage 80 parallel to coupling axis 38 in the direction of the first half-coupling on metallurgical carriage 10. Pins 44' and 44" of the first half-coupling penetrate through the drilled holes 58' and 58" of the second half-coupling and the male component 30 enters the female component 28 in order to connect together the gas pipes 20 and 16. If there is any horizontal misalignment between the two half-couplings 22 and 24, the second half-coupling slides on the rods 88. If there is a vertical misalignment between the two half-couplings 22 and 24, the first half-coupling slides on the rods 40. In this connection, it will be noted that the first half-coupling is generally lower than the second half-coupling since the relative position of the two half-couplings is set for carriage 10 without ladle 14. The movement of actuator 84 is stopped by an end-of-travel contactor 102 mounted on the second half-coupling. This end-of-travel contactor is, for example, actuated by the male component 30 during its axial withdrawal or by one of the two pins 44' and 44". The second coupling 24 is now engaged on pins 44' and 44" of the first half-coupling in such a way that locking plate 66 can enter the recesses 64 in them. In this position, male component 30 is pressed into female component 28 with sufficient contact pressure by spring 52.

Control device 92 is then activated so as to push locking plate 66 from its second position into its first position. The pins 62' and 62" are thus released and second half-coupling 24 is locked to first half-coupling 22. The operation of connecting flexible conduit 20 to metallurgical carriage 10 has ended and coupling carriage 80 is withdrawn into its parked position. Metallurgical carriage 10, which now supports second half-coupling 24 connected to the flexible conduit 20, can move forward from position B to position C. It should be noted that, during this travel, flexible conduit 20 is preferably automatically wound on to, or unwound from, a drum 110 located between position B and position C, more exactly at a point equidistant from position B and position C.

When metallurgical carriage 10, which is still connected to the flexible conduit 20, returns from position C to position B, it stops at its predefined coupling position. Coupling carriage 80 is then moved forward from its parked position in the direction of carriage 10 so as to enter, with the pins 62' and 62", the drilled holes 60' and 60" of second half-coupling 24 coupled to the first half-coupling. Control device 92 is then actuated so as to move locking plate 66 from its first position into its second position. In other words, second half-coupling 24 is unlocked from first half-coupling 22 and is locked to coupling carriage 80. Coupling carriage 80 is then withdrawn into its parked position. Metallurgical carriage 10 can now continue its travel from position B to position A, without having to drag along the flexible conduit 20.

It will be appreciated that neither the operation of coupling nor the operation of uncoupling metallurgical carriage 10 and flexible conduit 20 requires human intervention on the carriage 10.

In the embodiment described above, flexible conduit 20 essentially comprises flexible conduits for the treatment gases. It is, however, obvious that flexible conduit 20 could also comprise pipes for compressed air and liquids, as well as cables for carrying electrical power or signals, provided that the first half-coupling and the second half-coupling are equipped with adequate half-connectors.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Apparatus for coupling a metallurgical carriage to a flexible conduit comprising:

a metallurgical carriage, said metallurgical carriage being movable between first and second positions;

a first half-coupling mounted on said metallurgical carriage;

at least one flexible conduit for supplying fluid material to said metallurgical carriage;

a second half-coupling connected to one end of said flexible conduit;

said first and second half-coupling being capable of being joined together to form a coupling;

a coupling station located at a coupling position for the metallurgical carriage, said coupling station being between said first and second positions of said metallurgical carriage and comprising:

a supporting block to receive and support said second half-coupling;

drive means for moving said supporting block from a parked position toward said first half-coupling, and vice versa, when said metallurgical carriage is in its predetermined coupling position;

locking means on said second half-coupling for selectively locking said second half-coupling to one or the other of said supporting block and said first half-coupling, said locking means having a first position in which it cooperates with at least one element of said first-half coupling to lock said second half-coupling to said first half-coupling, and said locking means having a second position in which it cooperates with at least one element of said supporting block to lock said second half-coupling to said supporting block.

2. Apparatus according to claim 1, wherein:

said second half-coupling is attached to guiding means for guiding said flexible conduit.

3. Apparatus according to claim 1, wherein:

said supporting block includes a first pair of pins positioned to engage a corresponding first pair of holes in said second half-coupling; and said first half coupling includes a second pair of pins which are positioned to engage a corresponding second pair of holes in said second half-coupling.

4. Apparatus according to claim 3, wherein:

said first and second half-couplings have a coupling axis, and wherein the pins of each of said first and second pairs of pins are arranged symmetrically with respect to said coupling axis.

5. Apparatus according to claim 3, wherein:

said locking means comprises a locking plate which is movable between said first position and said second position, said locking plate in the first position becoming engaged in recesses in said first pair of pins to lock said second half-coupling to said supporting block, and said locking plate in the second position becoming engaged in recesses in said second pair of pins to lock said second half-coupling to said first half-coupling.

6. Apparatus according to claim 5, wherein:

said locking plate includes an actuating lever: and the apparatus further including:

control means for operating said actuating lever.

7. Apparatus according to claim 6 wherein:

said control means includes two actuators symmetrical with respect to said actuating lever.

8. Apparatus according to claim 1, wherein said first and second half-couplings have a coupling axis, and wherein:

said first half-coupling is mounted on the metallurgical carriage so as to have one degree of freedom along a first direction perpendicular to the coupling axis; and said supporting block is mounted on said coupling station so as to have one degree of freedom along a second direction which is perpendicular to the coupling axis and perpendicular to said first direction.

9. Apparatus according to claim 8, wherein:

the degree of freedom of said supporting block is defined along a horizontal direction by elastic elements symmetrically disposed about a central position.

10. Apparatus according to claim 9, wherein:

the degree of freedom of said first half-coupling is a vertical degree of freedom defined by elastic elements producing an upward elastic force.

11. Apparatus according to claim 1, wherein:

one of said two half-couplings incorporates a male half-connector which cooperates with a female half-connector on the other half-coupling.

12. Apparatus according to claim 11, wherein:

said male half-connector is axially movable against the action of a spring.

13. Apparatus according to claim 1, wherein:

said flexible conduit comprises at least one flexible gas pipe.

14. Apparatus for coupling a metallurgical carriage to a flexible conduit comprising:

a first half-coupling mounted on the metallurgical carriage;

a second half-coupling connected to one end of at least one flexible conduit;

said first and second half-coupling being capable of being joined together to form a coupling;

a coupling station located at a coupling position for the metallurgical carriage, said coupling station comprising:

a supporting block to receive anti support said second half-coupling;

drive means for moving said supporting block from a parked position toward said first half-coupling, and vice versa, when said metallurgical carriage is in its predetermined coupling position;

locking means on said second half-coupling for selectively locking said second half-coupling to one or the other of said supporting block and said first half-coupling, said locking means having a first position in which it cooperates with at least one element of said first-half coupling to lock said second half-coupling to said first half-coupling, and said locking means having a second position in which it cooperates with at least one element of said supporting block to lock said second half-coupling to said supporting block.

15. Apparatus according to claim 14 wherein:

said second half-coupling is attached to guiding means for guiding said flexible conduit.

16. Apparatus according to claim 14, wherein:

said supporting block includes a first pair of pins positioned to engage a corresponding first pair of holes in said second half-coupling; and said first half coupling includes a second pair of pins which are positioned to engage a corresponding second pair of holes in said second half-coupling.

17. Apparatus according to claim 16, wherein:

said first and second half-couplings have a coupling axis, and wherein the pins of each of said first and second pairs of pins are arranged symmetrically with respect to said coupling axis.

18. Apparatus according to claim 16, wherein:

said locking means comprises a locking plate which is movable between said first position and said second position, said locking plate in the first position becoming engaged in recesses in said first pair of pins to lock said second half-coupling to said supporting block, and said locking plate in the second position becoming engaged in recesses in said second pair of pins to lock said second half-coupling to said first half-coupling.

19. Apparatus according to claim 18, wherein:

said locking plate includes an actuating lever: and the apparatus further including:

control means for operating said actuating lever.

20. Apparatus according to claim 19 wherein:

said control means includes two actuators symmetrical with respect to said actuating lever.

21. Apparatus according to claim 14, wherein said first and second half-couplings have a coupling axis, and wherein:

said first half-coupling is mounted on the metallurgical carriage so as to have one degree of freedom along a first direction perpendicular to the coupling axis; and said supporting block is mounted on said coupling station so as to have one degree of freedom along a second direction which is perpendicular to the coupling axis and perpendicular to said first direction.

22. Apparatus according to claim 21, wherein:

the degree of freedom of said supporting block is defined along a horizontal direction by elastic elements symmetrically disposed about a central position.

23. Apparatus according to claim 22, wherein:

the degree of freedom of said first half-coupling is a vertical degree of freedom defined by elastic elements producing an upward elastic force.

24. Apparatus according to claim 14, wherein:

one of said two half-couplings incorporates a male half-connector which cooperates with a female half-connector on the other half-coupling.

25. Apparatus according to claim 24, wherein:

said male half-connector is axially movable against the action of a spring.

* * * * *